US007287979B2

(12) United States Patent
Backes et al.

(10) Patent No.: US 7,287,979 B2
(45) Date of Patent: Oct. 30, 2007

(54) BURNER FOR A HEATER

(75) Inventors: Uwe Backes, Bayview (AU); Stephane Wilfred Thomas, Annandale (AU)

(73) Assignee: Esmart Group Pty. Limited, Mona Vale (AU)

( * ) Notice: Subject to any disclaimer, the term of this patent is extended or adjusted under 35 U.S.C. 154(b) by 0 days.

(21) Appl. No.: 10/543,130

(22) PCT Filed: Oct. 25, 2004

(86) PCT No.: PCT/AU2004/001467

§ 371 (c)(1),
(2), (4) Date: Jul. 22, 2005

(87) PCT Pub. No.: WO2005/040678

PCT Pub. Date: May 6, 2005

(65) Prior Publication Data

US 2006/0134575 A1 Jun. 22, 2006

(30) Foreign Application Priority Data

Oct. 24, 2003 (AU) ..... 2003905880

(51) Int. Cl.
*F23D 14/28* (2006.01)
*F23D 5/02* (2006.01)

(52) U.S. Cl. ..... 431/344; 431/340; 431/338

(58) Field of Classification Search ..... 431/344, 431/333, 338, 340; 126/43, 44
See application file for complete search history.

(56) References Cited

U.S. PATENT DOCUMENTS 3,885,904 A 5/1975 Feng
4,013,190 A * 3/1977 Wiggins et al. ..... 220/501
4,170,981 A 10/1979 Hakata
4,416,617 A 11/1983 Ebbeson
4,793,321 A * 12/1988 Rafford et al. ..... 126/43

FOREIGN PATENT DOCUMENTS

| | | |
|---|---|---|
| CA | 2 193 896 | 6/1998 |
| CA | 2193896 | 6/1998 |
| DE | 20304139 U1 | 5/2003 |
| EP | 1 209 413 A1 | 5/2002 |
| FR | 2498300 A1 | 7/1982 |
| GB | 1 454 214 | 11/1976 |
| JP | 10-281415 | 10/1998 |

OTHER PUBLICATIONS

International Search Report dated Dec. 3, 2004, for International Application No. PCT/AU2004/001467.

* cited by examiner

*Primary Examiner*—Alfred Basichas
(74) *Attorney, Agent, or Firm*—Blank Rome LLP

(57) ABSTRACT

The present invention provides a burner (10) for a heater for combustion of a hydrocarbon liquid. The burner (10) comprises a combustion chamber having a combustion zone (17) for combusting the hydrocarbon liquid and at least one tank portion (13, 15) for containing an amount of the hydrocarbon liquid. The or each tank portion (13, 15) is positioned adjacent the combustion zone (17) and arranged to feed the hydrocarbon liquid into the combustion zone (17). The or each tank portion (13, 15) is at least in part filled with a filling material having a plurality of portions that pass through the interior of the or each tank portion (13, 15).

6 Claims, 2 Drawing Sheets

BURNER FOR A HEATER

FIELD OF THE INVENTION

The present invention broadly relates to a burner for a heater. The burner is arranged for combustion of a hydrocarbon liquid.

BACKGROUND OF THE INVENTION

Traditionally, heating of buildings such as private homes involves gas, oil, wood and electric heaters. Generally, wood heaters have the disadvantage that a flue is required for exhaust fumes and that the wood needs to be stored. In many dwellings such as apartments, units and townhouses installation of a flue and storage of the wood may cause problems or may not be possible at all. Gas heaters have similar problems as a gas connection is required. Oil heaters also need to be flued. Electrical heaters are generally rather expensive to operate and require electrical connections.

One interesting and largely environmentally clean alternative is a heater that is arranged for combustion of a hydrocarbon liquid such as an alcohol. For example, if ethanol is combusted, the exhaust products are largely limited to carbon dioxide and water steam.

A simple burner for ethanol has previously been used to provide a heat source for a fireplace. This burner comprises an open tank in which ethanol is combusted. However, as ethanol and other hydrocarbon liquids are easily combustible and may even be explosive if in vapour form or mixed with air, there is a need for a burner for a hydrocarbon liquid that provides improved safety.

SUMMARY OF THE INVENTION

The present invention provides in a first aspect a burner for a heater for combustion of a hydrocarbon liquid, the burner comprising:

a combustion chamber having a combustion zone for combusting the hydrocarbon liquid and at least one tank portion for containing an amount of the hydrocarbon liquid, the or each tank portion being positioned adjacent the combustion zone and being arranged to feed the hydrocarbon liquid into the combustion zone, the or each tank portion being at least in part filled with a filling material having a plurality of portions that pass through the interior of the or each tank portion.

A combustible gas over the surface of the hydrocarbon liquid typically needs to have a temperature above a threshold value to ignite. The filling material typically is arranged for distribution of at least some of the heat that is in use developed in the combustion zone and directed into the or each tank portion whereby local heat maxima in the tank portion are reduced and thereby likelihood of ignition in the tank portion is reduced. Further, as typically burning of the hydrocarbon liquid in the tank portion is avoided, fuel efficiency is also increased.

For example the filling material may comprise a large number, such as more than one hundred or more than one thousand particles which define spaces between them. Alternatively, the filling material may comprise a mesh or gauze such as a mesh or gauze of wires or fibres or a metallic wool such as steel wool. The filling material may comprise a metallic material, a plastics material, a mineral or any other suitable material. The steel wool may be stainless steel wool which has superior corrosion properties compared with conventional steel wool.

The heater may be a heater for heating at least a portion of a building such as a commercial space or a home. For example, the burner may form a part of a fireplace.

The burner typically comprises a combustion control means for controlling gas exchange of the combustion in the combustion zone.

For example, the control means may comprise an opening that allows diffusion of oxygen into the combustion chamber and a closure for the opening. This particular arrangement has the advantage that operation of the flame of the burner may be extinguished at any time by simply closing the opening and thereby interrupting the supply of oxygen required for the combustion. This feature therefore provides a further significant safety advantage.

The control means may also be arranged to regulate the oxygen diffusion into the combustion chamber so as to regulate the combustion properties of the burner. This feature therefore allows the regulation of the heat and flame output and of the consumption of the hydrocarbon liquid.

For example, the combustion control means may comprise a shutter that is arranged to adjust the opening and/or close the opening so that combustion may be controlled and/or to extinguish a flame in the combustion zone. The combustion chamber may comprise a lid portion in which the opening is positioned and the shutter may be arranged to slide across the opening of the lid portion. The shutter typically is guided by a guide and moveable relative to the opening typically in a straight direction. The shutter may also be connected to the combustion chamber by a hinge that allows the sliding movement. In this case, the hinge may be arranged for movement about a vertical axis.

Alternatively, the shutter may be moveable relative to the opening in a direction that has a vertical component. In this case the hinge typically is arranged for movement about a horizontal axis.

The shutter may be positioned inside the combustion chamber and may be arranged for sliding across an inner surface of the lid portion. In a specific embodiment the shutter and the lid portion are arranged so that the shutter may not interfere with objects located on the burner. Further, a mechanism that may be associated with the shutter may be positioned so that it cannot easily be accessed from the outside of the combustion chamber which further improves the safety of the burner. Further, the shutter may comprise rollers which are guided by guides in the lid portion and which improve the smoothness of the sliding motion when the shutter is moved and thereby reduce likelihood of spark formation.

In order to reduce the likelihood of jamming of the shutter, a portion of the shutter that in use is in contact with the lid portion may comprise a material that is softer than the lid portion which it contacts. In one specific embodiment the shutter is arranged so that, when the opening is closed, the lid portion overlaps the shutter. Because of the overlap, the likelihood of oxygen diffusion into the combustion chamber with an amount sufficient for combustion is further reduced which further improves the safety of the burner. Further, the shutter may comprise a handle portion that in use projects through a slot of the lid portion and the burner may be arranged so that movement of the handle portion along the slot effects sliding of the shutter across the opening of the lid portion. The chamber may be configured such that oxygen diffusion through the slot is substantially inhibited.

The combustion chamber may comprise stainless steel and the softer material may be brass. Spacers may be positioned at an external portion of the burner arranged for positioning between the burner and an item that supports the burner so that direct contact of the burner with the item is avoided and the item may comprise a combustible material such as a timber material. For example, the burner with the spacers may be arranged for positioning in the combustible material. The burner may also comprise a tray in which the burner is positioned and which is arranged to avoid direct contact with the combustible material.

The heater typically is arranged for positioning in an item so that at least a portion of the burner is positioned below a surface of the item. For example, the heater may be arranged for positioning in the item so that the surface of the item is approximately at the same level as a top portion of the combustion chamber. The heater may be arranged for positioning in a fireplace or any other building portion or in a furniture item such as a table. The heater typically does not have any connections such as fuel lines and typically is arranged for manual refilling. This has the particular advantage that it is relatively easy to install the heater in a building. Further, typically no flue is required.

The combustion chamber may comprise a fuel inlet opening through which the hydrocarbon liquid may be filled into the or each tank portion of the combustion chamber. The fuel inlet opening is typically remote from the opening of the combustion control means.

Further, the fuel inlet opening may comprise a closure, such as a shutter, and the burner may be arranged so that, when the shutter of the combustion control means is fully open, the shutter of the fuel inlet opening is closed and only when at least a portion of the shutter of the combustion control means is closed the fuel inlet opening is fully open. In a specific embodiment the shutter of the combustion control means and the shutter of the fuel inlet means are provided in form of an integral part.

The fuel inlet opening may also comprise a grid through which the hydrocarbon liquid is filled into a tank portion. The grid functions to reduce the likelihood of formation of air pockets in the hydrocarbon liquid during filling and formation of air bubbles when the fuel is filled into the tank portion.

In a specific example the combustion chamber comprises two tank portions between which the combustion zone is positioned. In this example the combustion zone is located underneath the opening of the combustion control means. The tank portions are separated from the combustion zone by wall portions that comprise apertures to allow the fuel to penetrate from the tank portions into the combustion zone.

The burner may be arranged for the combustion of any hydrocarbon liquid including any type of alcohol. In a specific embodiment the burner is arranged for the combustion of ethanol or methylated spirits which has the advantage that the combustion is largely environmentally friendly.

The present invention provides in a second aspect a heater comprising the above-defined burner.

The present invention provides in a third aspect a a heater for combustion of a hydrocarbon liquid, the burner comprising:

a combustion chamber having a combustion zone for combusting the hydrocarbon liquid and at least one tank portion for containing an amount of the hydrocarbon liquid, the or each tank portion being positioned adjacent the combustion zone and being arranged to feed the hydrocarbon liquid into the combustion zone, and a fuel inlet portion having a closure, and a combustion control means for controlling gas exchange of the combustion zone through an gas exchange opening of the combustion chamber wherein the closure of the fuel inlet opening is arranged so that filling of the fuel into the or each tank portion is only possible if the combustion control means closes at least a portion of the gas exchange opening of the combustion chamber.

The combustion control means typically comprises a shutter for controlling the gas exchange through the gas exchange opening of the combustion chamber. The closure of the fuel inlet opening typically also includes a shutter. Typically the shutter for controlling gas and the shutter of the fuel inlet opening are coupled and may also be integrally formed.

The invention will be more fully understood from the following description of a specific embodiment. The description is provided with reference to the accompanying drawings.

DETAILED DESCRIPTION OF A SPECIFIC EMBODIMENT

Figure 1:
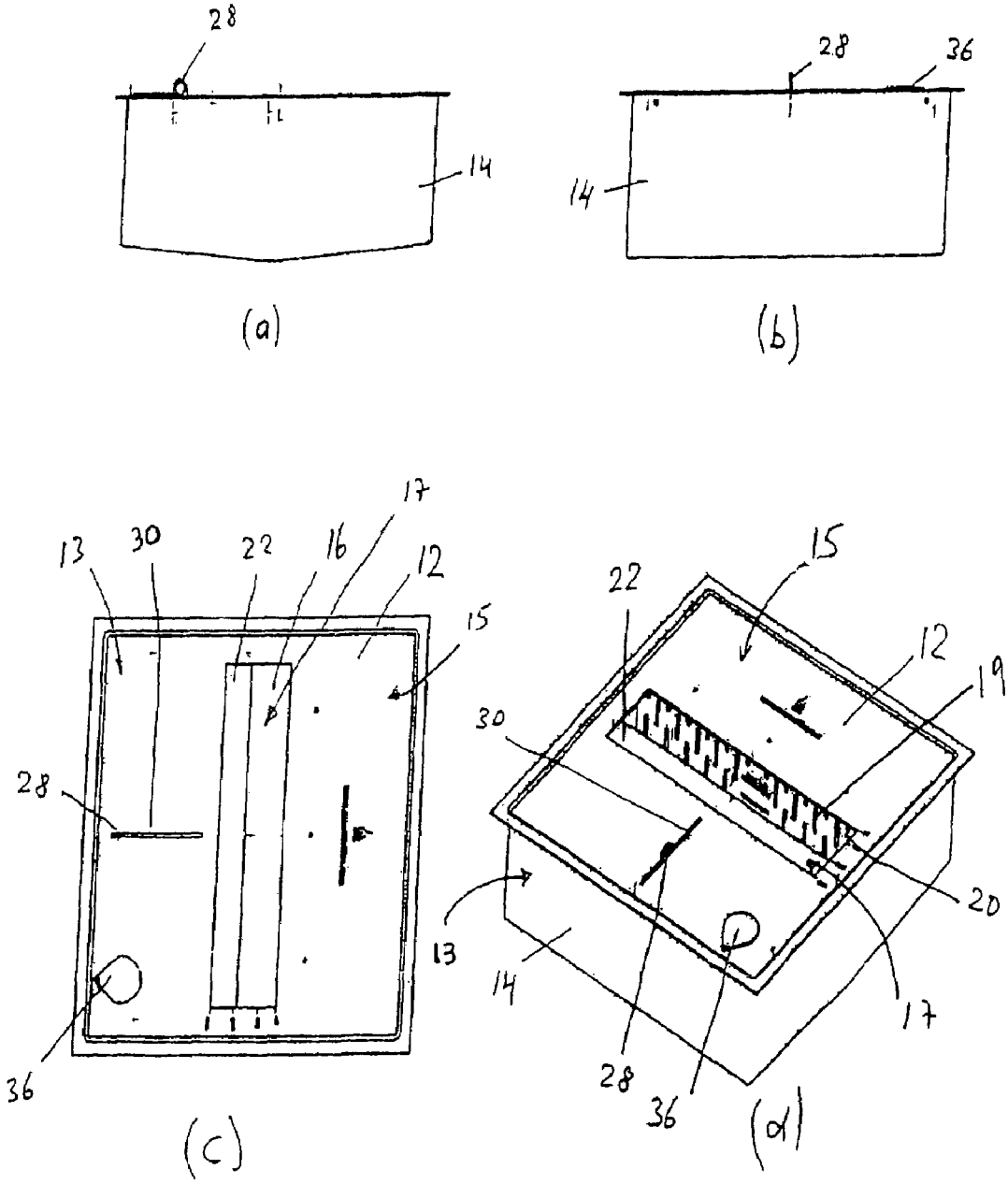
FIG. 1 is (a) a side-view, (b) a further side-view, (c) a top-view and (d) a perspective view of a burner for a heater according to a specific embodiment.
Figure 2:
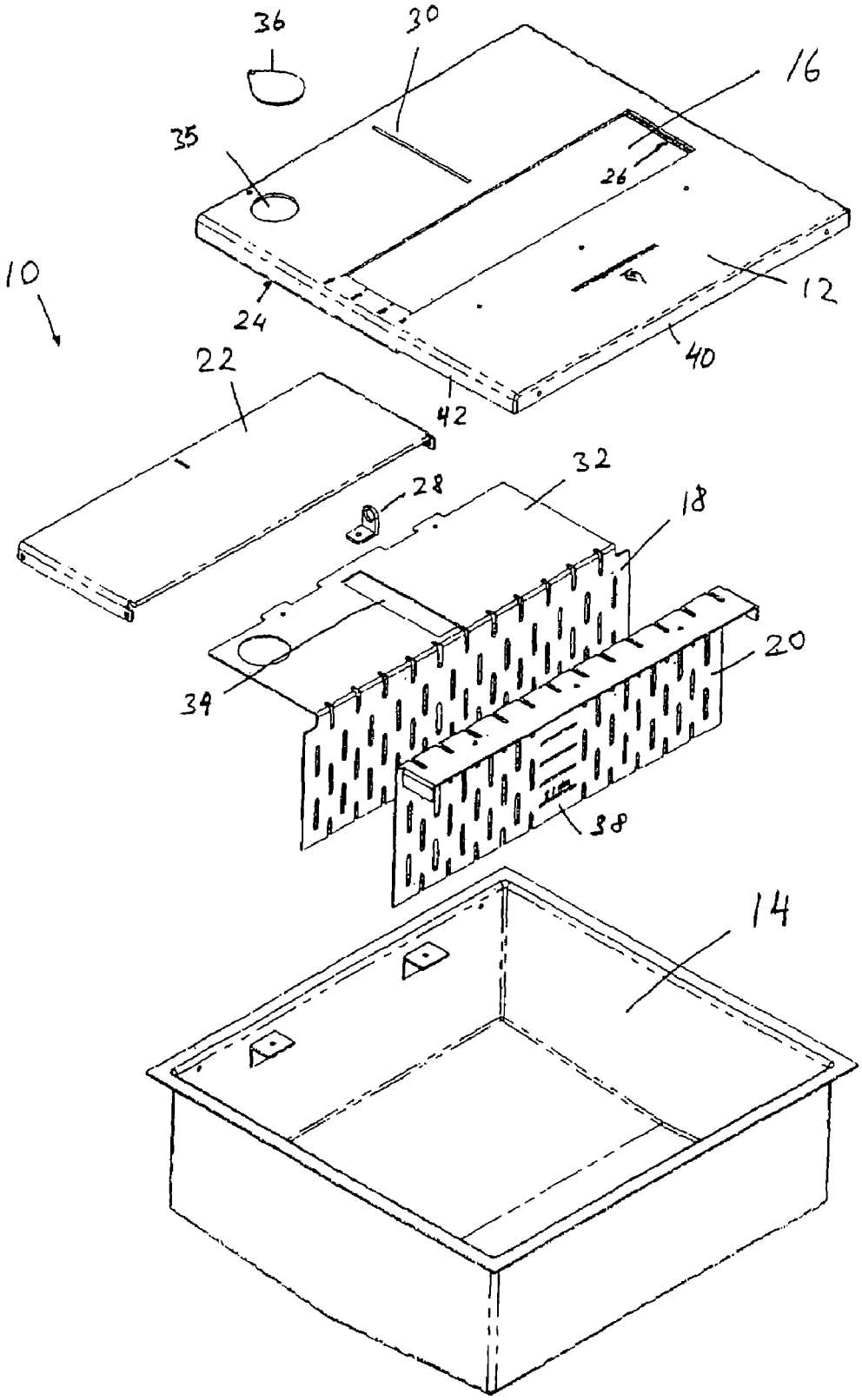
FIG. 2 is a perspective and exploded view of components of the burner shown in FIG. 1.

Referring to FIGS. 1 and 2 the burner for a heater according to a specific embodiment is now described. In this embodiment the burner 10 comprises a lid portion 12 and a body portion 14. The lid portion 12 and body portion 14 are composed of stainless steel. The lid portion 12 has an opening 16 below which the combustion zone 17 of the burner is located.

In this embodiment, the combustion zone 17 is positioned between two tank portions 13 and 15 of the burner and stainless steel walls 18 and 20 separate the tank portions 13 and 15 from the combustion zone 17. The walls 18 and 20 have apertures 19 which allow the hydrocarbon liquid to penetrate from the tank portions 13 and 15 into the combustion zone 17. The tank portions 13 and 15 are filled with stainless steel wool (not shown) which distributes heat and reduces likelihood of ignition in the tank portions 13 and 15 and thereby reduces formation of air pockets within the hydrocarbon liquid. It will be appreciated that in alternative embodiments the burner may take any other suitable form. For example, the burner may comprise one or more than two tank portions.

Further, the tank portions may be filled with any material that conducts heat and that allows fuel to be stored in the tank portions. Alternative examples any type of metal wool (not necessarily stainless) and a large number of small particles such as metal balls. Further the material with which the tank portions are filled may not necessarily be metallic but may comprise a non-metallic material.

In this embodiment, the burner 10 is arranged for the combustion of ethanol or methylated spirits which has the advantage that the combustion is largely environmentally friendly.

The burner also comprises a shutter 22 that is guided by guides 24 and 26. The shutter 22 has a handle portion 28 that projects through a slot 30 of the lid portion 12. By moving the handle portion 28 along the slot 30 the shutter adjusts the opening 16 and thereby controls the exchange of oxygen and exhaust through the opening 16 (and also controls the convection of oxygen within the combustion chamber). This allows to control heat output of the burner and the fuel consumption. Further, the shutter may fully close opening 16 so that the penetration of oxygen into the combustion chamber is substantially stopped whereby the flame in the combustion zone is extinguished. The shutter 22 is larger than the opening 16 so that in a closed position the shutter 22 overlaps lid portion 12 from the inside and, due to the overlap, the likelihood of diffusion of an amount of oxygen into the combustion chamber that is sufficient for combustion is further reduced.

Wall portion 18 comprises a flat portion 32 which has a recess portion 34 positioned underneath handle portion 28 and slot 30 so as to prevent diffusion of oxygen through the slot into the interior of the burner 10. In this embodiment the shutter 22 comprises brass rollers (not shown) which are received by guides 24 and 26 so that during sliding of the shutters the rollers roll in guides 24 and 26 which reduces friction. Further, as the rollers are composed of brass which is a soft material, likelihood of jamming is reduced.

It will be appreciated that in alternative embodiments the shutter may take any other form and shape. For example, the shutter may be hingetly connected to the body portion 14 or to the lid 12 portion. Alternatively, the shutter may be a lid that is removable from the body portion lid.

The lid portion 12 comprises a fuel inlet opening 35 which has an internal grid (not shown) through which during a fuel filling process fuel penetrates and which reduces likelihood of formation of air pockets in the fuel. The shutter 22, the opening 34 and the opening 16 are arranged so that, when shutter 22 opens fuel inlet opening 35, the shutter 22 closes at least a portion of opening 16 and thereby reduces the flame in the combustion zone which improves the safety during filling the hydrocarbon liquid into the burner 10. Further, fuel inlet opening 35 has a lid 36 and in this specific embodiment wall 20 has a scale that functions as a fuel level indicator.

In this embodiment the burner is largely composed of stainless steel (the exception being the brass rollers of the shutter 22) which resists corrosion. However, in variations of the embodiment the burner may be composed of any other suitable metallic or non-metallic material and may also comprise ceramics materials.

The body 14 has a V-shaped bottom portion 38 and therefore gravity permits the direction of the hydrocarbon liquid to the combustion zone. The lid portion 12 has lips 40 and 42 which are arranged to be slidingly received by the interior of the body portion 14 and thereby provide a largely oxygen diffusion tight connection with the body portion 14.

The burner 10 may also comprise spacers (not shown) such as brackets that allow the burner to be installed into a combustible medium such as a timber plate. In this case the spacers may be arranged to inhibit direct contact of the combustion chamber and the combustible medium. The burner 10 typically is arranged for insertion into a cavity of an item such as a portion of a building, eg a fire place, or a furniture item such as a table. Typically an upper edge of the burner 10 is flush with a surface of the item.

Although the invention has been described with reference to particular examples, it will be appreciated by those skilled in the art that the invention may be embodied in many other forms. For example, the burner may be arranged for the combustion of any hydrocarbon liquid. Further, the burner may have any volume, size and shape including for example round, rectangular and triangular shapes.

The invention claimed is:

1. A burner for a heater for combustion of a hydrocarbon liquid, the burner comprising:

a combustion chamber having a combustion zone for combusting the hydrocarbon liquid and at least one tank portion for containing an amount of the hydrocarbon liquid, the or each tank portion being positioned adjacent the combustion zone and being arranged to feed the hydrocarbon liquid into the combustion zone, and a fuel inlet portion having a closure; and a combustion control means for controlling gas exchange of the combustion zone through an gas exchange opening of the combustion chamber, wherein the burner is arranged so that the fuel inlet opening is only fully open when the combustion control means closes at least a portion of the gas exchange opening of the combustion chamber.

2. The burner as claimed in claim 1 wherein the combustion control means comprises a shutter for controlling the gas exchange through the gas exchange opening of the combustion chamber.

3. The burner as claimed in claim 2 wherein the shutter for controlling gas also is arranged for closing the fuel inlet opening.

4. A burner for a heater for combustion of a hydrocarbon liquid, the burner comprising:

a combustion chamber having a combustion zone for combusting the hydrocarbon liquid and at least one tank portion for containing an amount of the hydrocarbon liquid, the or each tank portion being positioned adjacent the combustion zone and being arranged to feed the hydrocarbon liquid into the combustion zone, the or each tank portion being at least in part filled with a filling material having a plurality of portions that pass through the interior of the or each tank portion;

a combustion control means for controlling gas exchange of the combustion in a first combustion zone, the control means comprising an opening that allows diffusion of oxygen into the combustion chamber and a shutter that is arranged to adjust the opening so as to control the combustion the combustion zone; and a fuel inlet opening for filling the hydrocarbon liquid into the burner, wherein the filling material is arranged for distribution of at least some of the heat that is developed in the combustion zone and is directed into the or each tank portion whereby at least one local heat maximum in the tank portion is reduced, thereby reducing the likelihood of ignition in the tank portion, and wherein the burner is arranged so that, when the shutter of the combustion control means is fully open, the fuel inlet opening is closed and only when at least a portion of the combustion control means is closed, the fuel inlet opening is fully open.

5. The burner of claim 4 wherein the burner is arranged so that when the shutter of the combustion control means is fully open, the shutter of the combustion control means closes the fuel inlet opening and only when at least a portion of the shutter of the combustion control means is closed, the fuel inlet opening is fully open.

6. A burner for a heater for combustion of a hydrocarbon liquid, the burner comprising:

a combustion chamber having a combustion zone for combusting the hydrocarbon liquid and two tank portions for containing an amount of the hydrocarbon liquid, the combustion zone being positioned between the tank portions and the tank portions being arranged to feed the hydrocarbon liquid into the combustion zone, the tank portions being at least in part filled with a filling material having a plurality of portions that pass through the interior of the tank portions, wherein the filling material is arranged for distribution of at least some of the heat that is developed in the combustion zone and is directed into the tank portions whereby at least one local heat maximum in the tank portions is reduced, thereby reducing the likelihood of ignition in the tank portions and wherein the tank portions are separated from the combustion zone by wall portions that comprise apertures to allow the fuel to penetrate from the tank portions into the combustion zone.

* * * * *